US005392891A

United States Patent [19]

Ferguson et al.

[11] Patent Number: 5,392,891

[45] Date of Patent: Feb. 28, 1995

[54] APPARATUS AND METHOD FOR DISCRIMINATING COINS BASED ON METAL CONTENT

[75] Inventors: Christopher Ferguson, Ashland, Mass.; J. Scott Petty, Cedar Rapids, Iowa

[73] Assignee: Raytheon Company, Lexington, Mass.

[21] Appl. No.: 194,551

[22] Filed: Feb. 10, 1994

[51] Int. Cl.[6] ..... G07D 5/08

[52] U.S. Cl. ..... 194/317; 194/343

[58] Field of Search ..... 194/317, 318, 319, 334, 194/342, 343; 453/3, 4

[56] References Cited

U.S. PATENT DOCUMENTS 3,317,016 5/1967 Turillon ..... 194/319
3,870,137 3/1975 Fougere .
3,952,851 4/1976 Fougere .
3,966,034 6/1976 Heiman et al. .
4,184,366 1/1980 Butler ..... 194/317 X

FOREIGN PATENT DOCUMENTS 500366 8/1992 European Pat. Off. ..... 194/317
2236420 4/1991 United Kingdom ..... 194/343

*Primary Examiner*—F. J. Bartuska
*Attorney, Agent, or Firm*—William R. Clark

[57] ABSTRACT

A method and apparatus for discriminating coins based on their metal or ferrous content. Coins are transported by a rotary mechanism that stops when a coin is accurately positioned with respect to an adjacent metal sensor. The metal sensor is then activated to provide a measurement signal of the coin in the repeatable stationary position. A plurality of measurements may preferably be taken and averaged to increase the accuracy.

10 Claims, 8 Drawing Sheets

APPARATUS AND METHOD FOR DISCRIMINATING COINS BASED ON METAL CONTENT

BACKGROUND OF THE INVENTION

This invention generally relates to coin operated devices, and more particularly relates to apparatus and methods used to discriminate coins based on their metal content.

As is well known, there are a variety of coin operated devices such as laundromat equipment, vending machines, toll booths, and public telephones. Generally, such devices identify a deposited coin or token by detecting coin characteristics or parameters, and comparing them to corresponding standards that are known for acceptable coin denominations. For example, some of these parameters are coin diameter, thickness, ferrous or metal content, and weight. Some of the more successful coin discrimination schemes employ a combination of parameters such as coin diameter discrimination combined with sensing the coin's metal characteristics.

There are a variety of prior art devices for measuring the metal content of coins. For example, in one arrangement the coin passes over an inductor which is part of a Colpitts oscillator circuit, and the metal in the coin alters the inductance of the circuit. In particular, when a ferromagnetic coin shunts an inductor in an alternating current circuit, the direction of change in inductance of the inductor depends on both the skin effect and the effect of shunting by the magnetic material. Generally, if the magnetic permeability of a coin is high and the conductivity is low, the inductance of the inductor will increase. If the permeability is low and the conductivity is high, the inductance will decrease. The metallic or ferrous content is then derived by measuring the amplitude of the oscillator output signal, and comparing it with known references.

One prior art metal content discriminating apparatus is described in U.S. Pat. No. 3,870,137. A coin is subjected to electromagnetic fields of at least two substantially different frequencies. A determination is made for each of the examination frequencies whether or not the interaction between the coin being tested and the electromagnetic field of that frequency produces the interaction effect within predetermined tolerances which is anticipated for acceptable electrically conductive coins.

Another prior art method and apparatus for metal content discrimination is described in U.S. Pat. No. 3,966,304. The disclosed method includes the steps of generating an alternating magnetic field, placing the coin to be tested with one face toward the source of the field, and comparing the phases of the field adjacent the two faces of the coin. This is practically accomplished by passing a first AC signal through a first wire thereby inducing a second AC signal in a second wire spaced from the first wire, placing a coin between the wires so as to shield direct paths from one wire to the other, and comparing the phases of the two AC signals. In a variation of this method, a third wire on the same side of the coin as the first wire may be used to sense the phase of the field on that side on the coin, in which case the phase of the AC signal induced in the third wire would be compared with that of the second AC signal.

One characteristic of these prior art metal content discrimination devices is that the coin rolls by the metal sensor or coil. In particular, the coin generally drops onto a coin track between sidewalls and rolls down the coin track on its edge under the influence of gravity. The sidewalls are parallel plates spaced apart by at least slightly more than the thickness of the thickest coin to be processed by the device. In addition, the sidewalls are typically tilted from the vertical so that a face on a coin rolling down the coin track bears on the metal content sensor or coil. Whether the measured parameter is amplitude, frequency, or phase, motion of a coin leads to inconsistencies that result in inaccurate measurements.

Another prior art metal sensor is described in U.S. Pat. No. 4,936,436 wherein the coin remains in the user's hand until it is validated as a proper coin. In particular, the coin goes in approximately one third of the way at which point the leading edge is detected. At this point, while the user still has a hold of the coin, the inserted portion is between two coils. An evaluation is done to determine if the coin is acceptable. If it is, the coin passage is opened, and the coin is received. With this method, the spacial disposition of the coin with respect to the coils may vary from use to use thereby detracting form the precision and repeatability of measurements.

SUMMARY OF THE INVENTION

In accordance with the invention, a coin metal content discriminating device includes a metal content sensor such as an inductor coil. A transport mechanism receives a coin to be evaluated, and transports the coin to a stationary position adjacent to the metal content sensor. The metal content sensor is then activated to provide an output signal that corresponds to the metal content of the coin as measured with the coin in the stationary position. Preferably, the transport mechanism includes a motor driven rotary disk having a coin receiving notch to carry the coin on a predetermined arcuate path to the stationary evaluation position. An optical sensor may be used to accurately position the rotary disk at a predetermined angular orientation with respect to the metal sensor. The measurement accuracy may be further improved by averaging a plurality of metal content signals. Metal content signals are compared to predetermined ranges of values corresponding to signals of acceptable coins. Then, in response thereto, the coin is accepted as being a particular denomination, or it is rejected.

With such arrangement, the metal content signals are provided while the coin is stationary. Thus, inconsistencies resulting from the coin rolling are eliminated. As a result, more accurate measurements and discrimination are provided. In particular, a rolling coin may be bouncing along a wall, so contact with the sensor coil may vary from measurement to measurement for even the same coin. Further, for a rolling coin, the measured parameter will generally be a bell shaped curve. However, by using a rotary disk to position the coins accurately, the same approximate relationship always exits between the coins and the sensor coil. In other words, the positioning of coins is accurately repeatable, so the measurements are accurate and repeatable. Further, the measured parameter will generally be a step curve, so multiple measurements under the same condition can be taken on each coin.

BRIEF DESCRIPTION OF THE DRAWINGS

The foregoing objects and advantages will be more fully understood by reading the following Description of the Preferred Embodiment with reference to the drawings wherein.

DESCRIPTION OF THE PREFERRED EMBODIMENT

Figure 2:
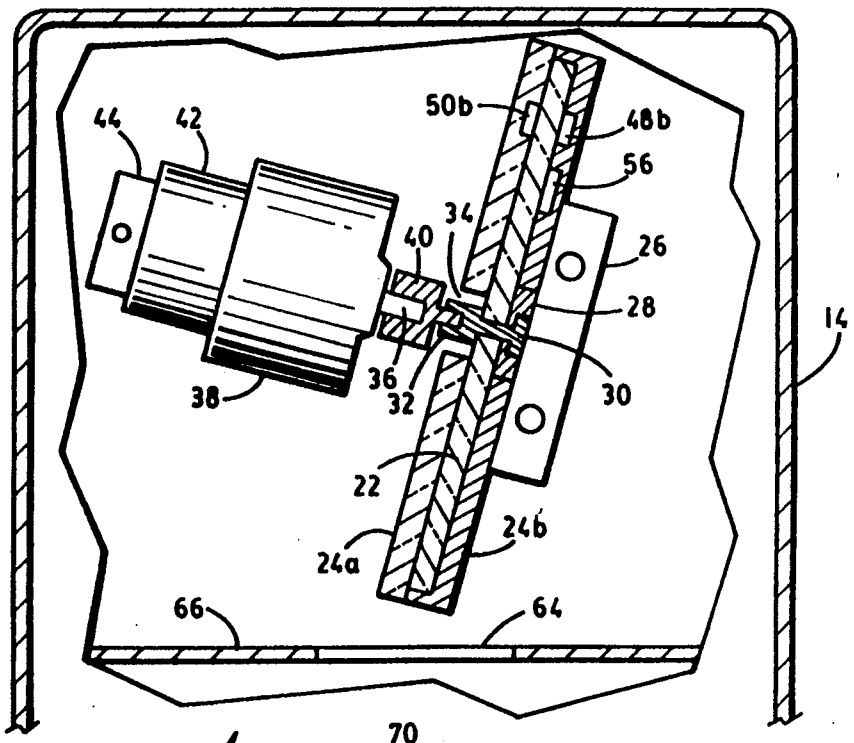
FIG. 2 is a front view of the coin transport mechanism of FIG. 1.
Figure 1:
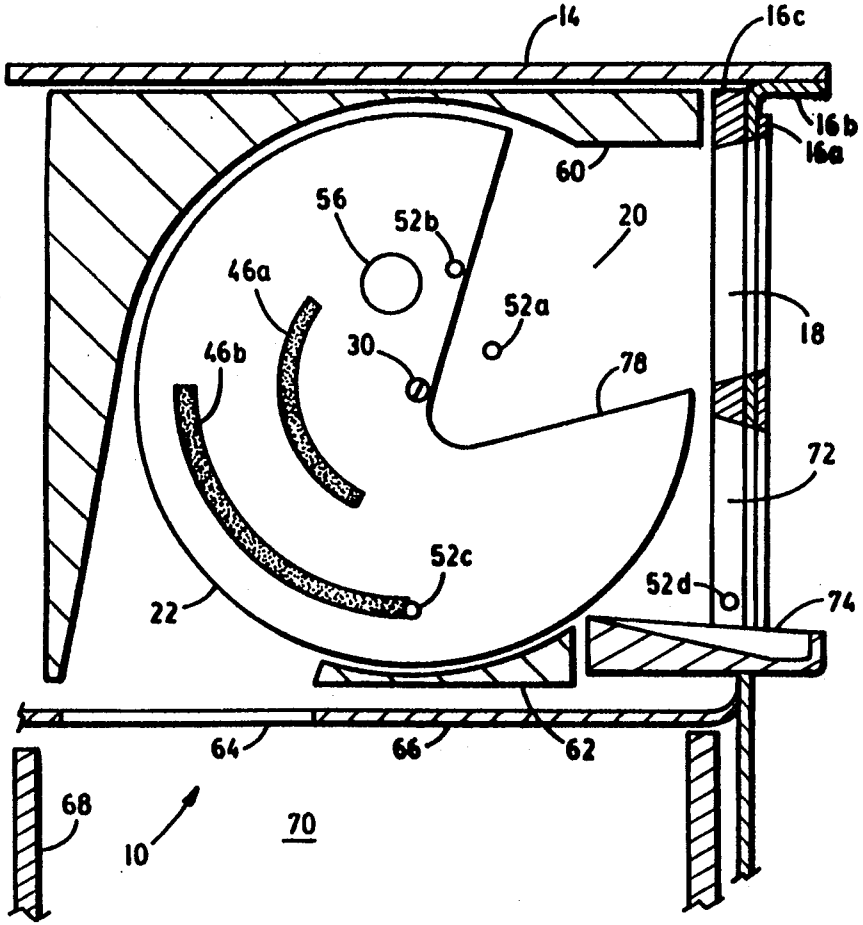
FIG. 1 is a partially sectioned side view of a coin transport mechanism.
Figure 3:
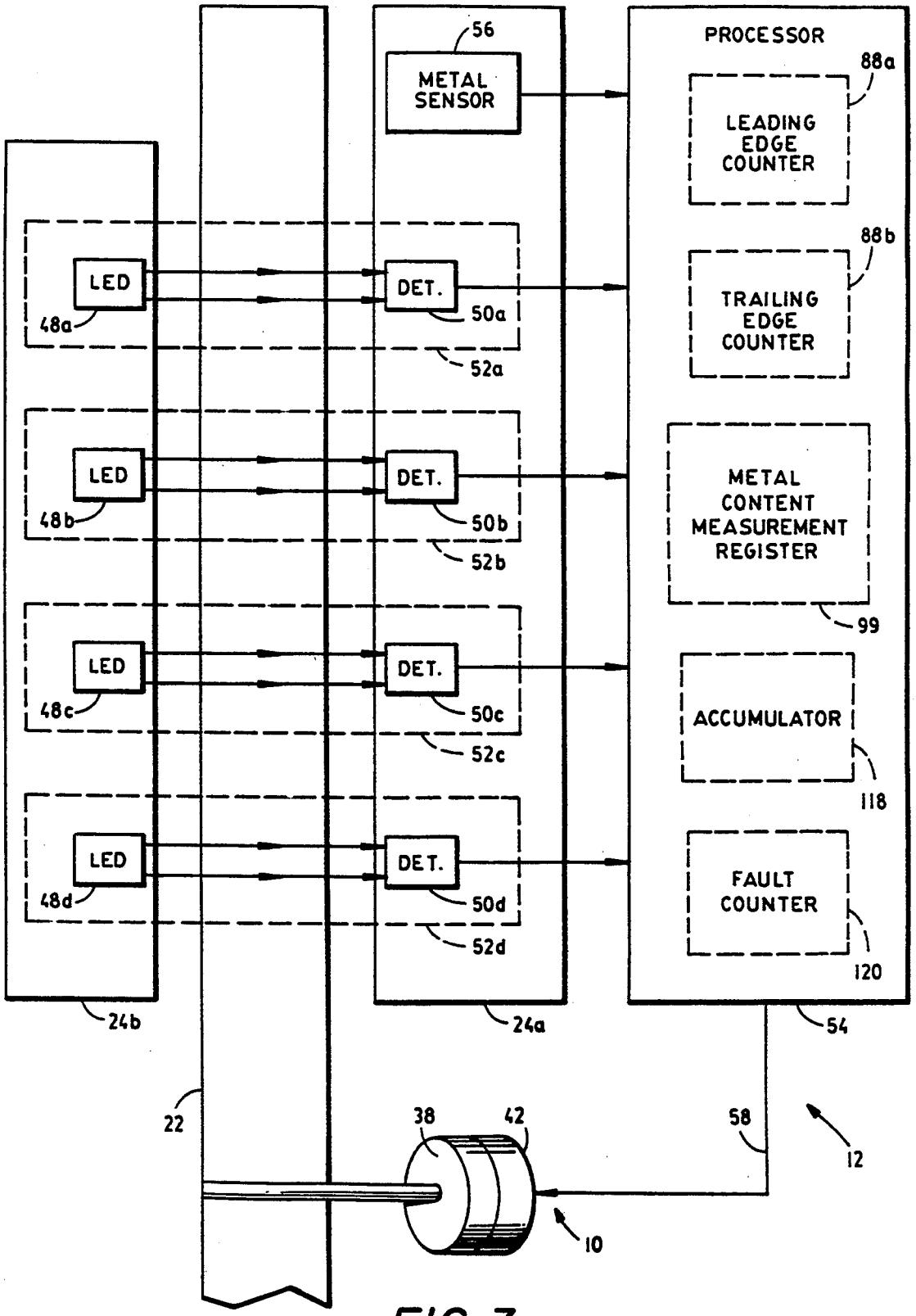
FIG. 3 is a simplified block diagram of a coin discrimination and collection system utilizing the coin transport mechanism of FIG. 1.

Referring to FIGS. 1 and 2, a coin transport mechanism 10 is adapted for use in a coin discrimination and collection system 12 as shown in FIG. 3. Coin transport mechanism 10 is here mounted within a security housing 14 such as would be used with coin operated laundry equipment. However, those of skill in the art will recognize that the coin discrimination and collection system 12 could be used in a variety of other applications such as vending machines, toll booths, and public telephones. Housing 14 here has front panel members 16*a–c* which form a coin slot 18 disposed at a suitable angle or tilt to align with a coin cavity or notch 20 in wheel or disk 22 which is at an angle as shown in FIG. 2. Disk 22 is sandwiched between upper and lower side plates 24*a* and *b* which are mounted in a stationary manner such as by bracket 26. A bearing 28 is mounted in lower side plate 24*b* and rotatably secures a shaft 30 which extends through and is secured to disk 22. The upper end 32 of shaft 30 extends through an aperture 34 in upper plate 24*a* and is connected to output shaft 36 of speed reducer 38 by a suitable coupling 40. Speed reducer 38 is driven by motor 42 which is suitably mounted such as by bracket 44. In operation in a manner to be described, actuation of motor 42 drives speed reducer 38 which rotates wheel or disk 22 and causes coin cavity or notch 20 to rotate about shaft 30 between stationary plates 24*a* and *b*. Coin notch 20 is rotated at a uniform angular velocity. In particular, uniform velocity is here provided by using a DC stepping motor 42 and pulsing at a high rate, here 600 pulses per second. With a relatively slow pulse rate, a stepper motor may start and stop thus resulting in ripple velocity. However, with a relatively high pulse rate such as 600 pulses per second, velocity ripple becomes negligible, and substantially constant velocity is attained. Here, a 30:1 speed reducer 38 is used to reduce the output speed of motor 42, so the 1800 RPM of the motor 42 is reduced to 60 RPM. Thus, for each pulse, disk 22 moves 0.6°.

Referring specifically to FIG. 1, wheel or disk 22 has inner and outer arcuate markers or masks 46*a* and *b* that have predetermined arcuate lengths and radial distances to control the operation of the coin transport mechanism 10 in a manner to be described later herein. Referring also to FIGS. 2 and 3, lower plate 24*b* has four embedded light emitting devices, here LEDs 48*a–d*, which are disposed opposite corresponding light sensitive devices, here detectors 50*a–d*, that collectively form light sensors 52*a–d*. Even though upper and lower plates 24*a* and *b* are omitted from FIG. 1 for simplicity of illustration, the location of light sensors 52*a–c* and metal detector 56 which are embedded therein are shown. The locations of light sensors 52*a–d* will be discussed later herein with reference to the operation of coin transport mechanism 10. Each detector 50*a–d* has an output coupled to processor 54. A conventional metal sensor 56 such as described in U.S. Pat. No. 3,966,034 is also embedded in lower plate 24*a*, and has an output coupled to processor 54. Lower plate 24*b* in which metal sensor 56 is embedded is preferably a low friction material such as polystyrene. If plate 24*b* is metal, a plastic donut (not shown) preferably encases metal sensor 56 to avoid interference with the alternating field emanating therefrom. Processor 54 has an output 58 which provides high frequency pulses such as 600 pulses per second to motor 42 in accordance with operation to be described.

Still referring to FIG. 1, an upper guide 60 and a lower guide 62 have arcuate surfaces disposed adjacent to disk 22. Lower guide 62 extends rearwardly to coin collection slot 64 in a floor 66 of housing 14. A coin collection box 68 is disposed in a chamber 70 below coin collection slot 64. Front panel members 16*a–c* further form a coin return slot 72 with a coin return chute 74. Like coin insert slot 18, coin return slot 72 is angled or sloped to receive coins from disk 22 which is angled or tilted as shown in FIG. 2.

Figure 4A:
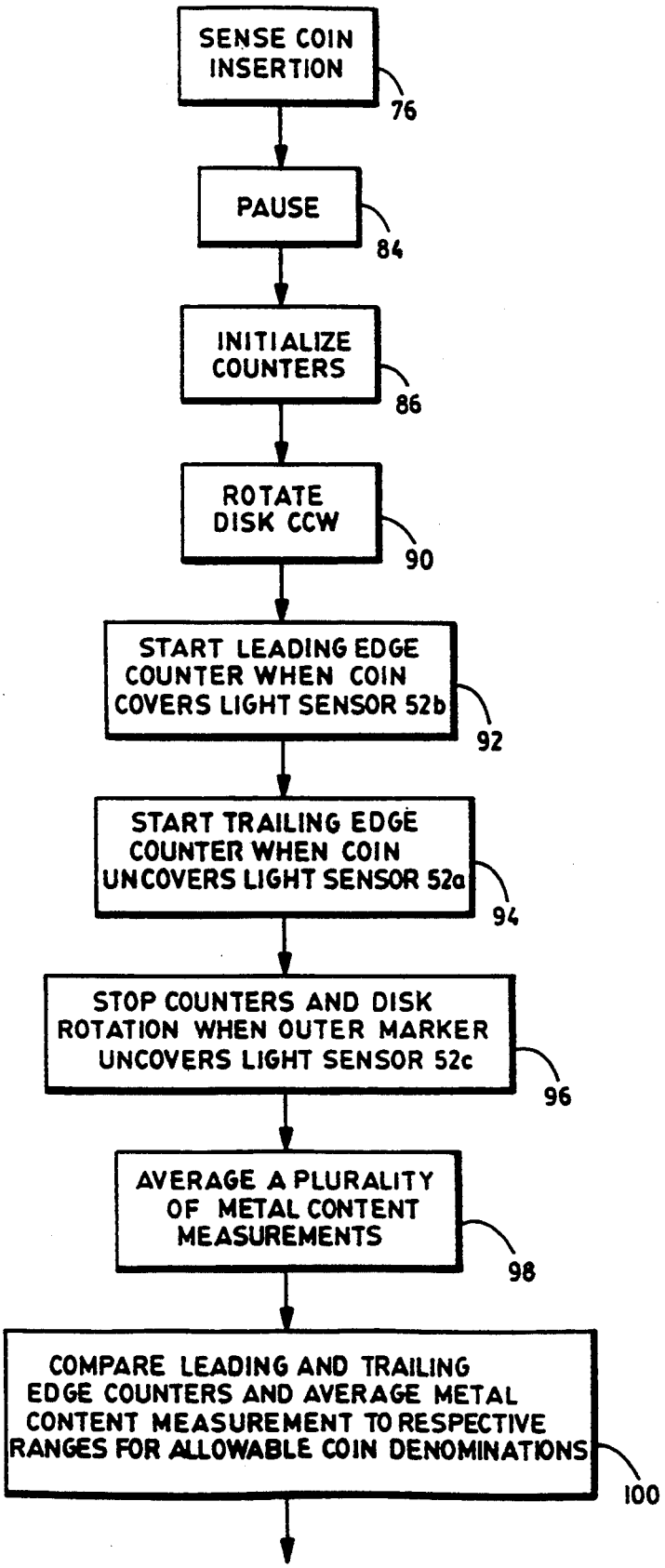
FIGS. 4A and 4B show a flow diagram depicting the operation of the coin discrimination and collection system.
Figure 5:
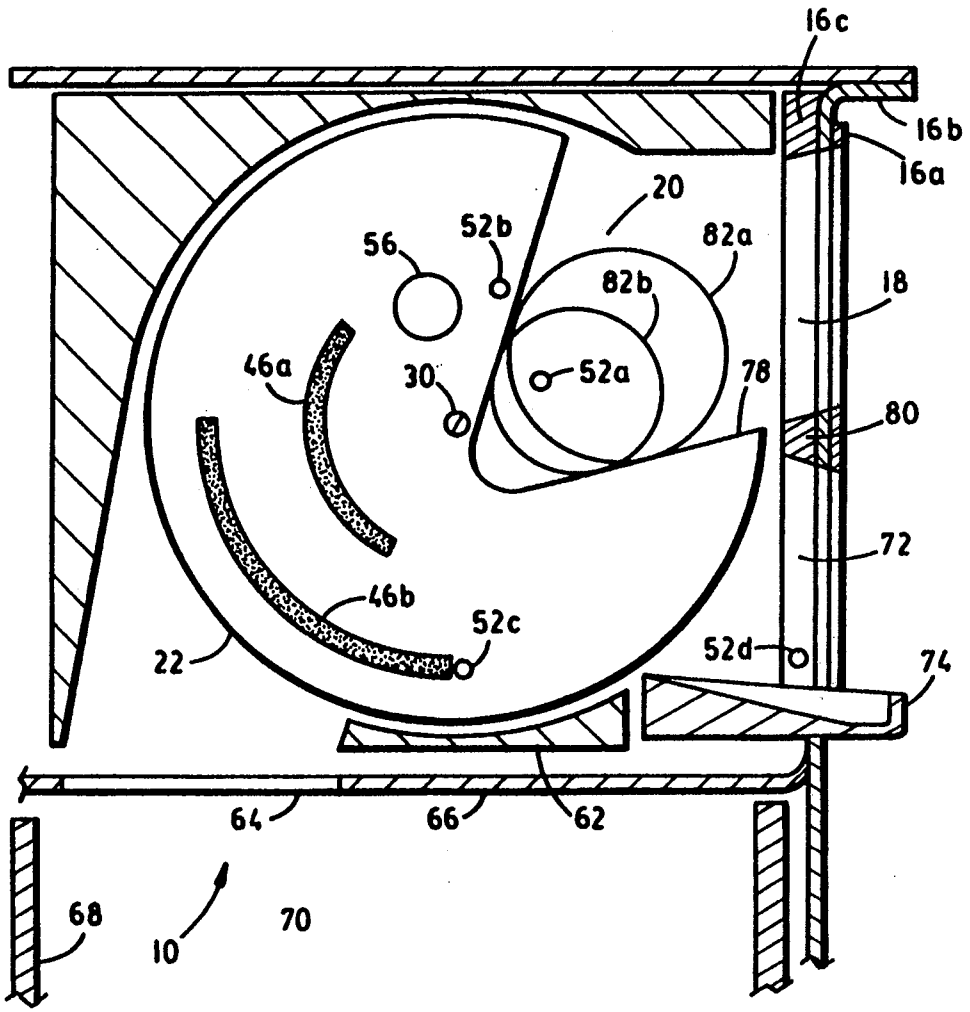
FIG. 5 is a side view of the coin transport mechanism after a coin has been received.

Referring to FIGS. 4A and B, the first step 76 in operation is to SENSE COIN INSERTION. Step 76 is performed using light sensor 52*a* as shown in FIG. 5. In particular, coin notch 20 is initially disposed to position edge 78 in alignment with the bottom 80 of coin insert slot 18, and light sensor 52*a* is disposed to transmit light from LED 48*a* across coin notch 20 to activate photo detector 50*a* when a coin is not present in coin notch 20. When a coin 82*a* or *b* is inserted by a user into coin insert slot 18, the coin 82*a* or *b* rolls down edge 78 and comes to rest in the nadir of notch 20 as shown in FIG. 5. Two coins 82*a* and *b* of different sizes or diameters are illustrated in FIG. 5 to show that light sensor 52*a* is disposed to be activated by coins of different sizes. In particular, a coin 82*a* or *b* breaks the light from LED 48*a* to photodetector 50*a*, and the change in state is interpreted by processor 54 to be that a coin 82*a* or *b* of unknown diameter has been inserted.

As shown in FIG. 4A, step 84 is to take a short PAUSE to permit the coin 82*a* or *b* to stop bouncing, and come to complete rest within coin notch 20 or pocket. Then, in step 86, processor 54 will INITIALIZE COUNTERS 88*a* and *b*. That is, leading and trailing edge time counters 88*a* and *b* as shown in FIG. 3 are reset to zero. As indicated by step 90, processor 54 then outputs 600 pulses per second on line output 58 to ROTATE DISK 22 CCW as referenced to FIG. 5. More specifically, while lower and upper plates 24*a* and *b* and embedded light sensors 52*a–d* remain stationary, disk 22 carrying coin 82*a* or *b* in coin notch 20 starts to rotate counterclockwise at a very uniform angular velocity.

Figure 6B:
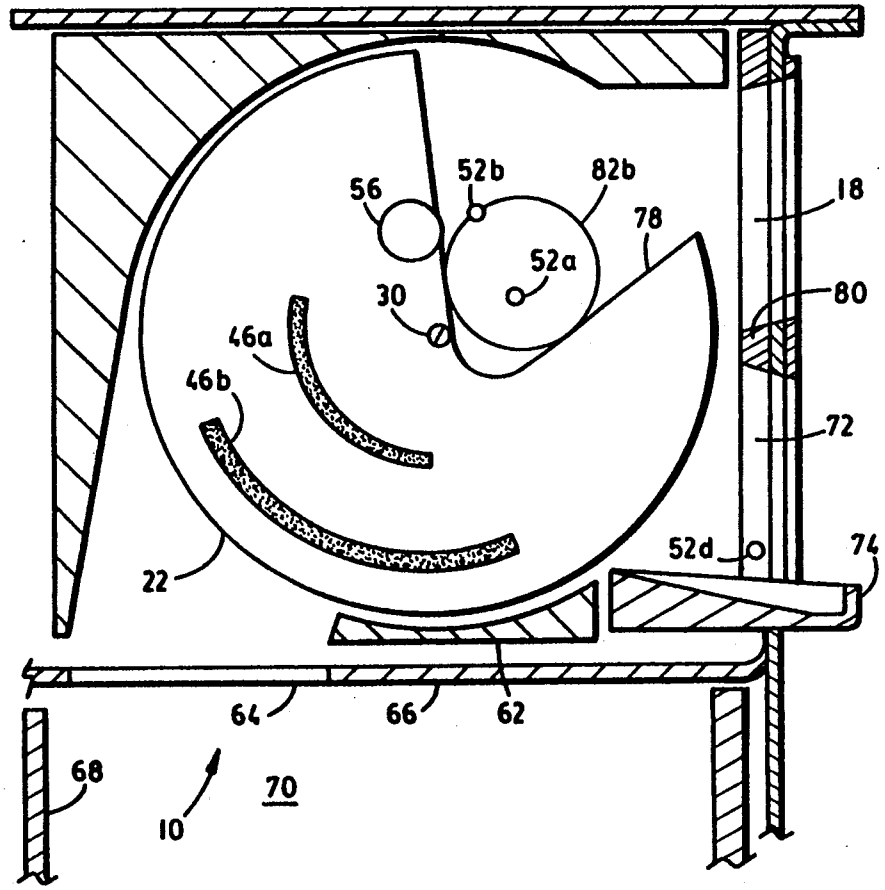
FIGS. 6A and 6B show angular rotations of the disk for two different denominations of coins, respectively.
Figure 6A:
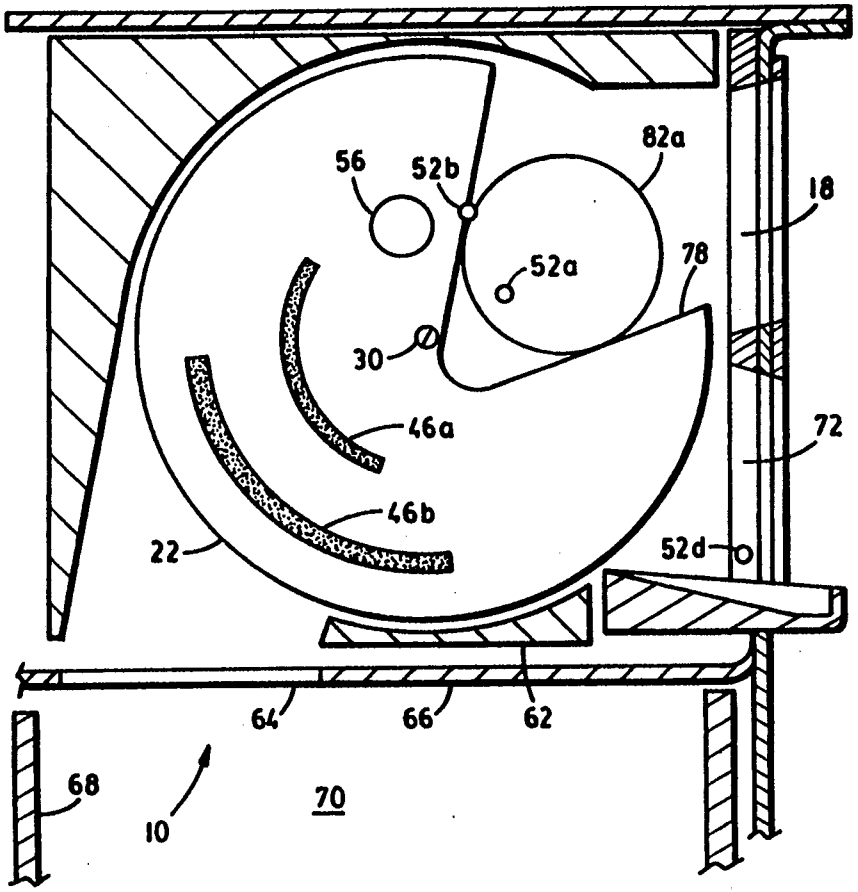

As indicated by step 92, processor 54 will START LEADING EDGE COUNTER 88*a* WHEN COIN COVERS LIGHT SENSOR 52*b*. In particular, wheel or disk 22 is made of a transparent material that permits light to be transmitted therethrough, so light from LED 48*b* activates photodetector 50*b* until the leading edge of a coin interrupts it. As shown by FIGS. 6A and 6B, the angular orientation of disk 22 when the leading edge of a coin arrives at light sensor 52*b* is a function of the size or diameter of the coin in notch 20. In particular, in FIG. 6A, coin 82*a* is relatively large, and the leading edge is detected by a change in state of photodetector 50*b* after only a relatively small rotation from the initial position as shown in FIG. 5. However, in FIG. 6B, coin 82*b* is relatively small and rests further down into the nadir of notch 20 thus permitting rotation of disk 22 through a larger angle before coin 82*b* breaks the transmission of light from LED 48*b* to photodetector 50*b*.

Referring to step 94 of FIG. 4A, processor 54 will then START TRAILING EDGE COUNTER 88*b* WHEN COIN UNCOVERS LIGHT SENSOR 52*a*. For example, as can be seen from FIGS. 6A and 6B, respective coins 82*a* and b cover light sensors 52*a*, and a separate trailing edge counter 88*b* is started when disk 22 rotates to an angular orientation where coins 82*a* or *b* no longer break the light path. As can be readily understood, the angular orientation of disk 22 when this occurs is also a function of the size, and more particularly the diameter, of the coin 82*a* or *b* in coin notch 20.

Figure 7:
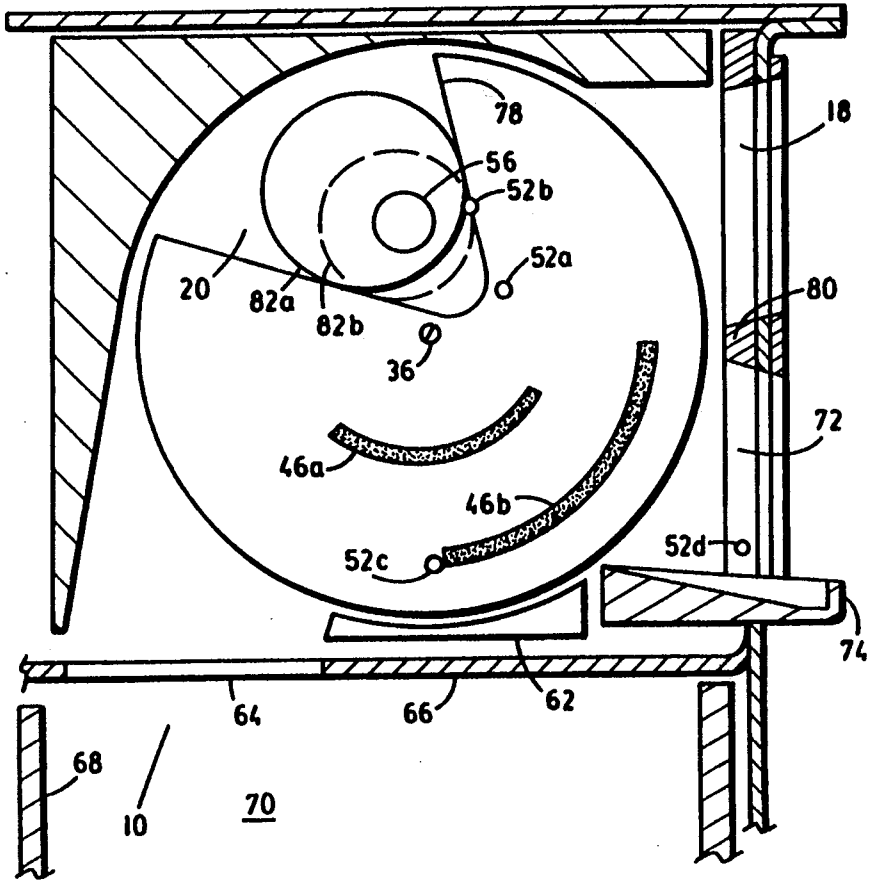
FIG. 7 shows the disk rotated to a coin evaluation orientation.

Referring again to FIG. 5, the initial angular orientation of disk 22 was determined by one end of outer marker 46*b* being aligned with light sensor 52*c* as shown. As indicated by step 96 of FIG. 4A, processor 54 will STOP COUNTERS 82*a* and *b* AND DISK 22 ROTATION WHEN OUTER MARKER 46*b* UNCOVERS LIGHT SENSOR 52*c*. Outer marker 46*b* is here an arcuate mask of 90°, so disk rotates 90° to the angular orientation shown in FIG. 7, at which time counters 88*a* and *b* are stopped. Thus, the contents of time counters 88*a* and *b* are elapsed time counts of the respective times to rotate disk 22 from respective positions or angular orientations where the leading and trailing edges of the coin 82*a* or *b* intersect light sensors 52*a* and *b* to a reference position, here 90° from the initial angular orientation. As described heretofore, the angular velocity of rotation is very uniform because it is accurately controlled by motor 42 at 0.6° per high frequency pulse from processor 54, so the counts in counters 88*a* and *b* also accurately represent the respective angular orientations of disk 22 when the leading and trailing edges of the coin 82*a* or *b* arrive at or intersect respective light sensors 52*a* and *b*. Furthermore, the angular orientation of disk 22 when leading and trailing edges of coin 82*a* or *b* intersect respective light sensors 52*a* and *b* is a function of the size, or more particularly the diameter, of coin 82*a* or *b*. Thus, the respective elapsed time counts in leading and trailing edge counters 88*a* and *b* accurately represent or correspond to the diameters of the coin 82*a* or *b* in coin notch 20 of disk 22. For example, with 600 pulses per second and each pulse rotating wheel 22 through an arc of 0.6°, wheel 22 would rotate at 1 revolution per second, or 0.25 seconds between the initial orientation as shown in FIG. 5 and the reference or evaluation orientation as shown in FIG. 7. In one operative embodiment, light sensor 52*b* may be positioned such that it is intersected by the leading edge of a dime at 143 milliseconds into the movement between orientations of FIG. 5 and FIG. 7, so the elapsed time count in leading edge counter 88*a* would be 107 milliseconds which, as described heretofore, corresponds to the diameter of the dime. In a similar manner, light sensor 52*a* may be positioned such that it is intersected by the trailing edge of a dime at 183 milliseconds into the movement, so trailing edge counter 88*b* would be 67 milliseconds. Likewise, typical counts in leading and trailing edge counters 88*a* and *b* for a nickel may be 140 and 87 milliseconds, respectively, and typical counts for a quarter may be 187 and 117 milliseconds, respectively. As will be described later herein, the actual measured times which correspond to the diameter of the coin 82*a* or *b* are compared to a known or standard range of acceptable times for each denomination of coin in use.

Although the use of elapsed time counters 88*a* and *b* has been described, those of skill in the art will recognize that there are other ways to provide signals indicative of the angular orientation of disk 22 at the time the leading and trailing edges of a coin 82*a* or *b* arrive at the light sensors 52*a* and *b*. For example, a mechanical resolver could be used to obtain angular orientation measurements. Also, rather than operating to a reference point, here the angular orientation of FIG. 7, a counter could be started by a leading edge and stopped by a trailing edge.

As indicated by step 98 of FIG. 4A, processor 54 will next AVERAGE A PLURALITY OF METAL CONTENT MEASUREMENTS, and store the result in metal content measurement register 99 (FIG. 3). As can be seen from FIG. 7, metal sensor 56 is positioned to be covered or adjacent to any sized coin 82*a* or *b* after disk 22 has been rotated through a predetermined angle, here 90°, from the initial orientation. Disk 22 and lower plate 24*a* are sloped or angled as shown best in FIG. 2 so coin 82*a* or b will be substantially flush against or parallel to metal sensor 56. Metal sensor 56 is a conventional metal content sensor such as one that positions the coin 82*a* or *b* in an inductive field of a coil in a circuit (not shown), and measures the coin's effect on the frequency, phase, or amplitude of the circuit's output. As is well known, the change in the measured parameter is, in part, a function of the metal content of the coin 82*a*. In contrast with prior art metal sensors techniques where the coin is rolled through the field, coin 82*a* is here stationary when a metal measurement is conducted. Thus, irregularities or inconsistencies caused by motion of the coin 82*a* are eliminated. Further, because disk 22 is accurately positioned by the end of marker 46*b* and light sensor 52*c*, approximately the same relationship always exits between the metal sensor 56 such as an inductor coil and coins 82*a* or *b* of a particular denomination.

As indicated by step 100 in FIG. 4A, processor 54 will then COMPARE LEADING AND TRAILING EDGE COUNTERS 88*a* and *b* AND AVERAGE METAL CONTENT MEASUREMENT TO RESPECTIVE RANGES FOR ALLOWABLE COIN DENOMINATIONS. There may be a variety of reasons why coins of the same denomination may result in slightly different leading and trailing edge measurements, and also different metal content measurements. For example, with respect to measured times, there may be slight variations in the alignment of or how the light sensors 52*a* and *b* are switched from one state to the other, or where the disk 22 is stopped by lower marker 46*b* and light sensor 52*c*. Further, there may be slight variations in the angular velocity of disk 22, or even in the diameters of like coins. With respect to metal content measurements, circuit parameters may vary, or coins may be worn or dirty, or may even have slightly different metal contents. In order to allow for variances in these parameters and others, acceptable ranges are formulated for each coin denomination that is allowed. These ranges may generally be formulated by sampling the measured leading and trailing edges times for a large number of coins of like denomination under a variety of conditions using different coin transport mechanisms 10. From this data, acceptable ranges may be determined using conventional statistical principles. For example, the range for leading and trailing edge counter times may typically be plus or minus 0.5 or 1 millisecond from the times given above for various denominations. In short, established limits of acceptability may generally be determined and stored such as in a look-up table for comparison with real time measurements of coin characteristics.

Figure 4B:
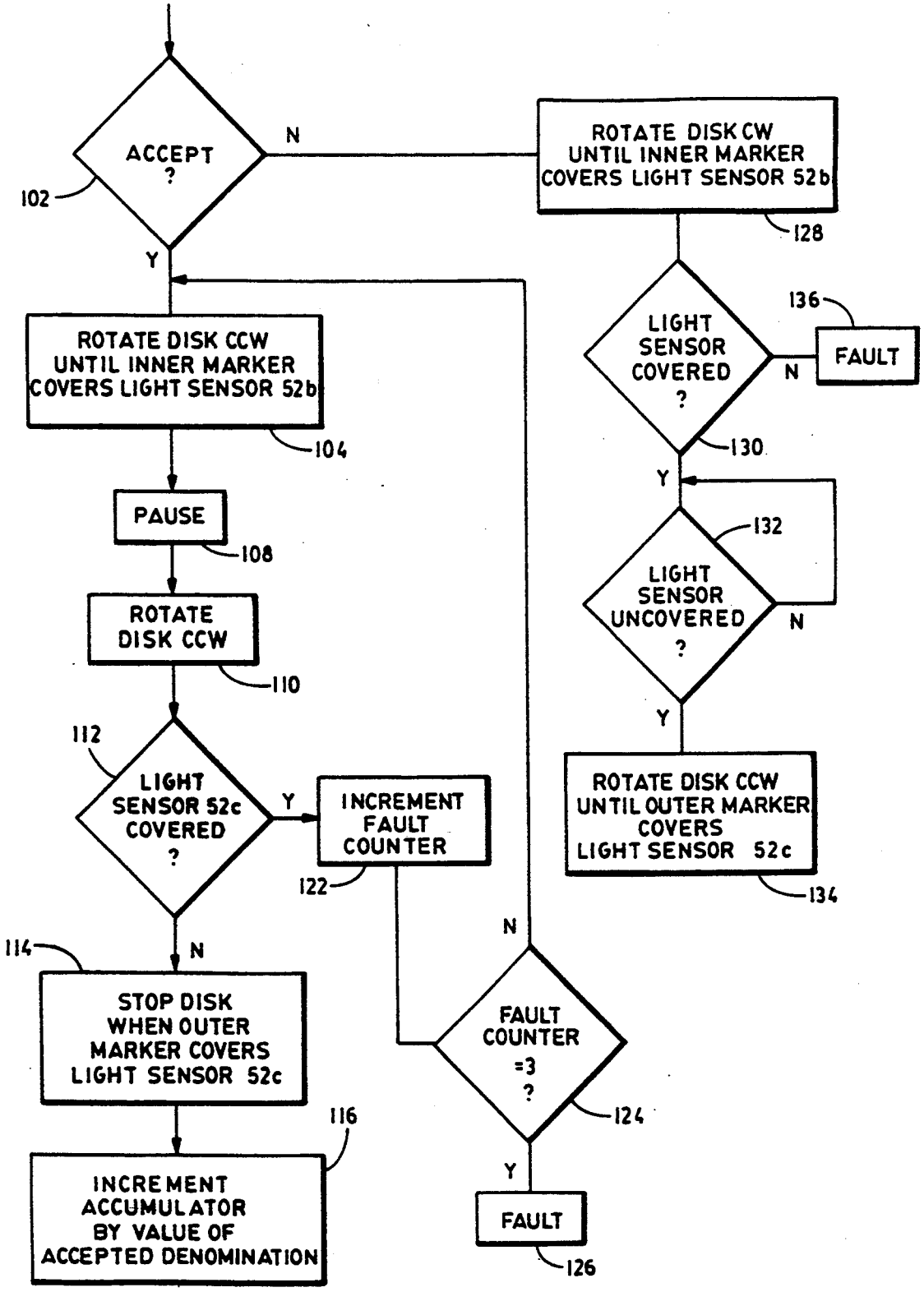

As indicated by step 102 as shown in FIG. 4B, processor 54 will then determine whether to ACCEPT ? or reject the coin 82*a* or *b* at the evaluation position shown in FIG. 7. Although a variety of algorithms may be used, processor 54 here merely determines if the stored elapsed time counts of the leading and trailing edge counters 88*a* and *b* are in the respective preprogrammed ranges for these parameters, and if the average metal content measurement falls in its preprogrammed range. If all three conditions are satisfied for a particular denomination of coin, the coin 82*a* or *b* is accepted for that denomination; and if any of the three conditions is not met for a particular denomination of coin, the coin 82*a* or *b* is rejected.

Figure 8:
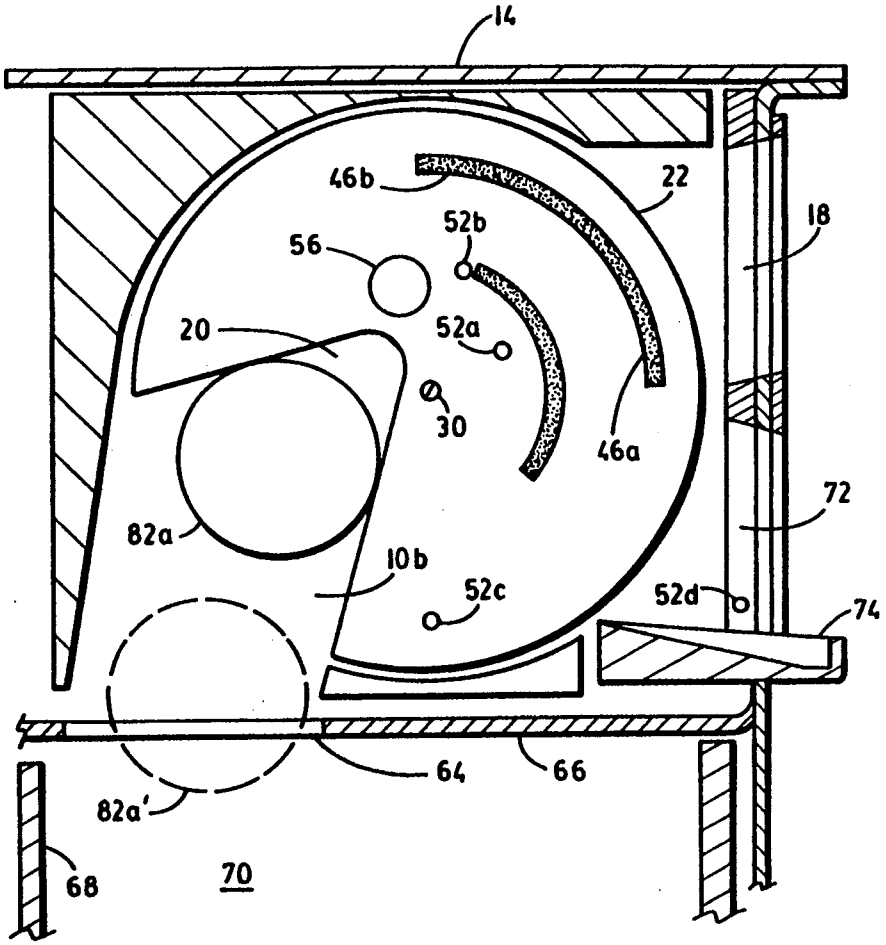
FIG. 8 shows the disk rotated to a coin collection orientation.

If the coin matches the parameters or characteristics (i.e. falls in the three ranges) of a particular coin denomination, processor 54 will ROTATE DISK 22 CCW UNTIL INNER MARKER 46*a* COVERS LIGHT SENSOR 52*b* as indicated by step 104 in FIG. 4B. More specifically, as shown in FIG. 8, disk 22 is rotated counterclockwise, here approximately 90°, to position the opening 106 of notch 20 facing downwardly above coin collection slot 64. In such position, processor 54 stops disk 22, and the coin 82*a* which has been accepted, falls to position 82*a'* down through coin collection slot 64 into coin collection box 68. After a suitable PAUSE as shown by step 108, processor 54 will ROTATE DISK 22 CCW as indicated by step 110.

As shown in FIG. 8, light sensor 52*c* is disposed to sense a lower portion of disk 22 in the CCW path of coin notch 20 in FIG. 8 and the initial orientation shown in FIG. 1. During the rotation of disk 22 in a CCW direction back to the initial position, processor 54 monitors light sensor 52*c* to determine if LIGHT SENSOR 52*c* COVERED ? as indicated by step 112. That is, processor 54 monitors for a change of state caused by a nontransparent object passing between LED 48*c* and photodetector 50*c*. If there is no such state change, processor 54 will STOP DISK 22 WHEN OUTER MARKER 46*b* COVERS LIGHT SENSOR 52*c* as indicated by step 114. Simply stated, disk 22 is returned to its initial orientation ready for insertion of another coin, and processor 54 will INCREMENT ACCUMULATOR 118 BY VALUE OF ACCEPTED DENOMINATION as indicated by step 116 in FIG. 4B. As is readily understood, an accumulator 118 is used to total the value of coins inserted towards a final value that is sufficient to activate the controlled machine, whether it be laundry equipment or a vending machine or the like.

Still referring to FIG. 4B, if light sensor 52*c* is covered during the rotation of disk 22 back to the initial orientation as indicated by step 112, that is indicative that the accepted coin 82*a* or *b* is still present in the coin notch 20. For example, such condition may have existed because a sticky substance was deposited on the edge of coin 82*a* or *b*. Without step 112, the process beginning with step 76 would continue in a loop and accumulator 118 would continue to increment with the coin 82*a* or *b* being lodged in notch 20. However, if an accepted coin 82*a* or *b* is not collected through coin collection slot 64 and continues to be present in coin notch 20, processor 54 will INCREMENT FAULT COUNTER 120 as indicated by step 122. As indicated by step 124, processor 54 will determine if FAULT COUNTER=3? If not, processor 54 will repeat steps 104, 108, 110 and 112 to determine if the jammed coin 82*a* or *b* subsequently becomes dislodged and drops through coin collection slot 64. If the coin 82*a* or *b* remains lodged in coin notch 20 such that fault counter 120 increments to 3, processor 54 will enter a FAULT mode as indicated by step 126. Suitable action may be taken, but coin transport mechanism 10 would generally be inoperable until service is provided to remove coin 82*a* or *b* from coin notch 20. It is noted that light sensors may perform more than one function. For example, light sensor 52*c* is used in conjunction with marker 46*b* to angularly locate disk 22, and also operates to sense the presence of coins 82*a* and *b*. In this respect, light sensor 52*c* must be located in a manner that it can perform both functions for all acceptable sizes of coins.

Figure 9:
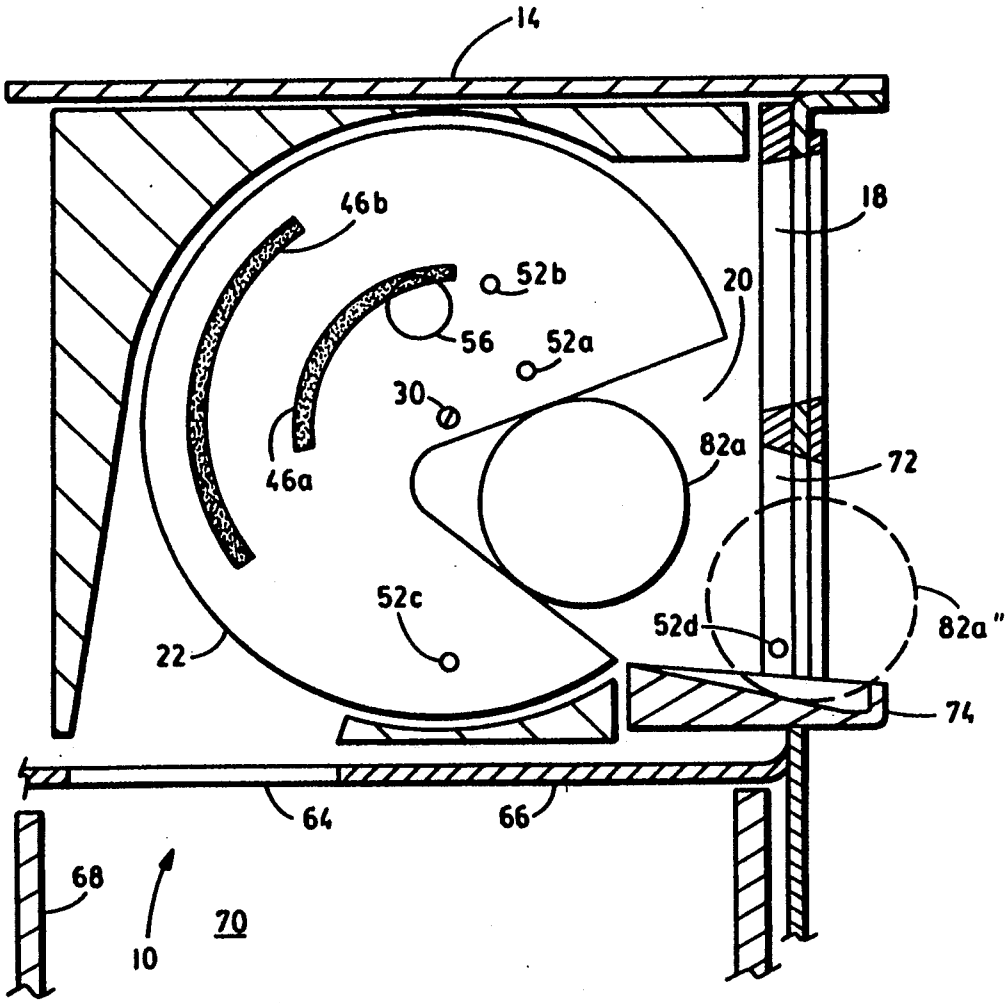
FIG. 9 shows the disk rotated to a coin return orientation.

Referring again to step 102, processor 54 will ROTATE DISK 22 CW UNTIL INNER MARKER 46*a* COVERS LIGHT SENSOR 52*b* as indicated by step 128 if the coin 82*a* or *b* is not accepted. Under such conditions, the disk 22 is rotated to the position shown in FIG. 9. Thus, the coin 82*a* is free to roll down edge 78 and coin return chute 74 through coin return slot 72 to position 82*a''*. Light sensor 52*d* is disposed in coin return slot 72 as shown, and processor 54 will determine if LIGHT SENSOR 52*d* COVERED ? as indicated by step 130. If it is covered, that is indicative that the coin 82*a* has rolled out of coin notch 20 to coin return chute 74, and processor 54 will then determine if LIGHT SENSOR 52*d* UNCOVERED ? as indicated by step 132. Such change of state of light sensor 52*d* would indicate that the user has removed the coin 82*a''* in which case processor 54 will ROTATE DISK 22 CCW UNTIL OUTER MARKER COVERS LIGHT SENSOR 52*c* as indicated by step 134. In short, such action would return the disk 22 to its initial operating orientation ready for insertion of another coin.

Referring again to step 130, processor 54 would indicate a FAULT as shown by step 136 if the coin 82*a* was not sensed as being returned. Disk 22 will remain in this position until coin 82*a* or *b* is removed. As discussed above, such condition could indicate that the coin 82*a* is lodged in coin notch 20 in which case service may be required. Further, if the coin 82*a* or *b* is not sensed as having been removed by the user is step 132, a loop will be executed until such action has occurred.

Referring again to FIGS. 1 and 5–7, edge 78 of notch 20 is curved. In particular, edge 78 is the driving edge that pushes coin 82*a* or *b* through an arcuate path between the angular orientations of FIG. 1 and FIG. 7, and edge 78 is here shaped to be substantially perpendicular to the desired direction of coin travel. Thus, there is no force component due to tangential coin acceleration that pushes the coin 82*a* or *b* outward from the center of disk 22. Therefore, the coin 82*a* or *b* does not move in notch 20 when the disk 22 accelerates up to speed. Further, the angle or shape of edge 78 exceeds a minimum angle to provide an inward force component that offsets or counteracts the centripetal acceleration of the coin 82*a* or *b* up to a speed such as 60 R.P.M. Hence, when a coin 82*a* or *b* is accelerated up to speed or at steady state, the coin 82*a* or *b* does not move in notch 20. That is, coin 82*a* or *b* has a fixed relationship with respect to disk 22 during the portion of time when diameter is being discriminated, and the velocity of coin 82*a* or *b* is accurately controlled along a predetermined arcuate path from the orientation of FIG. 5 to the orientation of FIG. 7. The path passes light sensors 52*a* and *b*.

Figure 10:
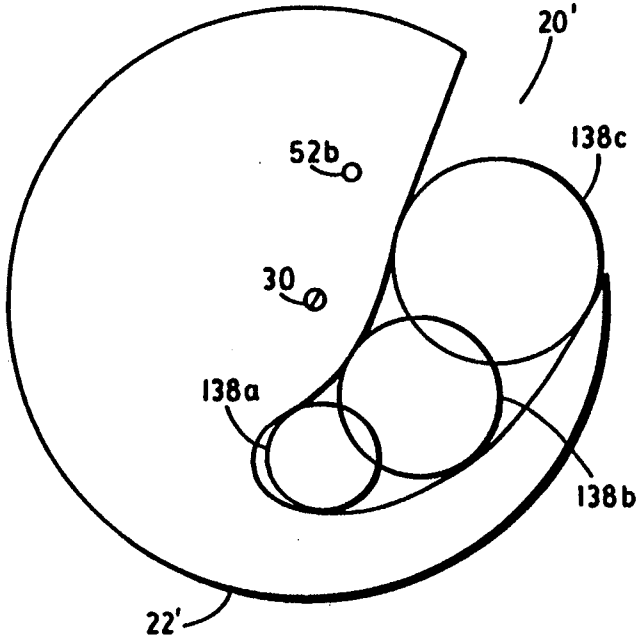
FIG. 10 shows an alternate embodiment for the disk.

The geometry or shape of notch 20 can also be selected to provide another advantage in diameter related measurements. In particular, see FIG. 5 and note that a center for a smaller coin 82*b* is located lower in the notch 20 than a larger coin 82*a*. This displacement difference contributes to the fact that the larger coin 82*a* arrives at light sensor 52*b* sooner than a small coin 82*b* when disk 22 is rotated. See FIGS. 6A and 6B for the respective angular orientations of leading edge arrival. The difference between these two angular orientations represents the diameter discrimination of coins. Referring now to FIG. 10, it can be seen that notch 20' is shaped such that a small coin 138*a* falls much further into the notch 20' than a larger coin 138*b* or *c*. Thus, there is a larger or increased angular difference between the arrival of a large coin 138*c* and a small coin 138*a* at light sensor 52*b*. Thus, a mechanical advantage in displacement of coins of different sizes within the notch 20' is provided. That is, there is nonlinear displacement of coins of different sizes within the notch 20' to amplify the difference between measurements of those sizes.

As described above, two coin diameter related measurements are made. The first measurement is stored in leading edge counter 88*a*, and is the elapsed time between the leading edge of the coin 82*a* or *b* intersecting or arriving at light sensor 52*b* and disk 22 arriving at the reference or evaluation orientation shown in FIG. 7. The second measurement is stored in trailing edge counter 88*b*, and is the elapsed time between the trailing edge of the coin 82*a* or *b* intersecting or arriving at light sensor 52*a* and disk 22 arriving at the reference or evaluation orientation shown in FIG. 7. It is noted that the reference point for stopping the counters 88*a* and *b* is the same for both measurements. Two diameter measurements may be more desirable than one because the leading edge measurement with light sensor 52*b* may tend to be more accurate for small diameter coins 82*b*, while the trailing edge measurement using light sensor 52*a* may tend to be more accurate for large coins 82*a*.

In summary, a number of advantages are provided by coin transport mechanism 10 and related apparatus and method. First, coin transport mechanism 10 carries a coin 82*a* or *b* at an accurately controlled velocity along a path where diameter related measurements are made without inconsistencies caused by a rolling coin. Also, coin transport mechanism 10 positions the coin 82*a* or *b* in a repeatable and accurately controlled stationary position adjacent to the metal sensor 56 so a plurality of accurate metal content measurements are made. Further, in all but the initial angular orientation of disk 22 as shown in FIG. 5, the periphery of disk 22 covers the coin insert slot 18 which prevents additional coins or implements from be inserted into and interfering with the coin evaluation process. Also, after a coin has been accepted because its characteristics match that of a known standard, the coin 82*a* or *b* is rotated so that the coin is collected. However, if the coin remains in notch 20 such as it might if a sticky substance had been placed on the coin 82*a* or *b* to cheat the system 12, that is detected by light sensor 52*c*, and no credit is given.

This completes the Description of the Preferred Embodiment. However, a reading of it by those skilled in the art will bring to mind many alterations and modifications that do not depart from the spirit and scope of the invention. Therefore, it is intended that the scope of the invention be limited only by the appended claims.

What is claimed is:

1. A coin metal content discriminating device comprising:

a metal content sensor;

means for transporting a received coin to a stationary position adjacent to said metal content sensor wherein said transporting means comprises a motor driven rotary disk having a coin receiving notch to carry the coin on a predetermined arcuate path to the position adjacent to the metal sensor; and means for activating said metal content sensor to provide an output signal corresponding to the metal content of the coin in the stationary position.

2. The device recited in claim 1 further comprising optical sensor means for accurately positioning said rotary disk at a predetermined angular orientation with respect to said metal sensor.

3. The device recited in claim 1 further comprising means for providing a average of a plurality of said metal content signals.

4. The device recited in claim 1 further comprising means for comparing output signals from said metal sensor to predetermined ranges of values corresponding to signals of acceptable coins.

5. The device recited in claim 4 further comprising means responsive to said comparing means for accepting or rejecting said coin.

6. A method of discriminating the metal content of a coin received through a coin insert slot, comprising the steps of:

transferring the coin to a stationary position adjacent to a metal sensor wherein the transferring step comprises the steps of receiving the coin in a notch of a rotary disk, and rotating the disk using a motor to carry the coin to the stationary position adjacent to the metal sensor; and activating the metal sensor to provide an output signal corresponding to the metal content of the coin in the stationary position.

7. The method recited in claim 6 wherein said transferring step further comprises a step of optically sensing the angular orientation of the disk to position the coin accurately at said stationary position.

8. The method recited in claim 6 further comprising steps of providing a average of a plurality of said metal content signals.

9. The method recited in claim 6 further comprising a step of comparing output signals from said metal sensor to predetermined ranges of values corresponding to signals of acceptable coins.

10. The method recited in claim 9 further comprising a step of accepting or rejecting said coin in response to the comparing step.

* * * * *